United States Patent [19]

Stephenson

[11] 3,969,795

[45] July 20, 1976

[54] SAFETY BELT BUCKLE

[75] Inventor: Robert L. Stephenson, Sterling Heights, Mich.

[73] Assignee: Allied Chemical Corporation, Morris Township, N.J.

[22] Filed: Sept. 16, 1974

[21] Appl. No.: 506,070

[52] U.S. Cl. ..... 24/203 AL; 24/230 A

[51] Int. Cl.[2] ..... A44B 11/26

[58] Field of Search .... 24/230 A, 230 AL, 230 AN, 24/230 R, 230 AO, 205.17

[56] References Cited

UNITED STATES PATENTS

| | | | |
|---|---|---|---|
| 209,903 | 11/1878 | Lane | 24/230 A |
| 2,847,748 | 8/1958 | Robinton | 24/230 AT |
| 3,473,201 | 10/1969 | Hopka | 24/230 AK |
| 3,555,632 | 1/1971 | Lindblad | 24/230 AL |
| 3,564,672 | 11/1968 | McIntyre | 24/230 AT |
| 3,704,633 | 12/1972 | Iverson | 24/230 AL |
| 3,763,523 | 10/1973 | Lindblad | 24/230 AL |
| 3,774,268 | 11/1973 | Holmberg | 24/230 A |
| 3,790,994 | 2/1974 | Jakob | 24/230 A |
| 3,795,030 | 3/1974 | Yates | 24/230 AL |

*Primary Examiner*—Bernard A. Gelak

*Attorney, Agent, or Firm*—John P. Kirby, Jr.; Ernest D. Buff

[57] ABSTRACT

A safety belt buckle is provided with a laminated housing formed of top, center and bottom plates. The top and bottom plates have an opening in the central portion thereof. The center plate has an opening extending from an edge of the plate into the center portion thereof, and is made of polymeric material. A guide means, formed by a portion of the center plate, extends from the interior of the buckle to a point of termination on the exterior surface of the housing, for guiding the tongue of a seat belt into the housing. The buckle is small, light, strong, reliable, easy to fasten, comfortable to wear and inexpensive to produce.

13 Claims, 5 Drawing Figures

SAFETY BELT BUCKLE

BACKGROUND OF THE INVENTION

1. FIELD OF THE INVENTION

This invention relates to safety belt buckles for passengers in vehicles, such as automobiles, and more particularly to improved means for housing the buckle and facilitating the operation of the components of the buckle.

2. DESCRIPTION OF THE PRIOR ART

Safety belt apparatus has been developed in order to reduce the number of fatalities and serious injuries resulting from motor vehicle accidents. Most of this apparatus includes, as major components, a buckle having a housing connected to a seat belt anchored to the vehicle body, a protective cover associated with the housing, and a latching mechanism that cooperates with the cover to engage the tongue of the seat belt. One of the problems encountered with such buckles is the difficulty of inserting the tongue into the housing. The rough entry caused by "hard points" encountered in the housing during insertion of the tongue either deters vehicle occupants from using safety belts, or leads them to believe that their belt is fastened when, in fact, it is not. Another problem encountered with such buckles is the tendency of the latching mechanism to be disabled by damage to the cover. Still another problem encountered with such buckles is the relatively large size, weight and cost thereof. The present invention provides a means whereby the aforesaid problems are overcome.

SUMMARY OF THE INVENTION

In accordance with the present invention a safety belt buckle is provided that is compact, lightweight, strong and reliable, and which virtually eliminates fastening problems such as rough entry, false latch and the like. The safety belt buckle contains a housing having an opening therein from which a cavity extends to a wall opposite the opening. An inlet means of the housing communicates with the cavity for receiving the tongue of a seat belt. The buckle has a connecting means for connecting the housing to the seat belt and a latching means for engaging the tongue thereof. The housing is formed of a plurality of laminated plates, including top, center and bottom plates. The top and bottom plates have an opening in the central portion thereof. The center plate is composed of polymeric material and is provided with an opening extending from an edge of the plate into the central portion thereof, such opening forming part of the inlet means. A portion of the center plate forms a guide means extending from the interior of the cavity to a point of termination on the exterior surface of the housing, for guiding the tongue into the housing.

The safety belt buckle of this invention has advantageous structural features. Each of the plates is easily fabricated and relatively strong. Thus, the housing is quickly and easily assembled at minimal cost to form a remarkable sturdy unit. Hard points on the exterior surface as well as within the cavity of the housing are replaced by a smooth guiding surface provided by the guide means. In addition, the guide means serve to effect and maintain proper alignment between the latching means and tongue of the buckle assembly. The latching means is functionally independent of the protective cover means and is not disabled by damage thereto. Further, use of a plastic center laminate reduces the weight of the buckle. As a result, the safety belt buckle of this invention is less expensive to produce, easier to fasten, more comfortable to wear and affords greater protection to vehicle occupants than previous safety belt buckles.

BRIEF DESCRIPTION OF THE DRAWINGS

The invention will be more fully understood and further advantages will become apparent when reference is made to the following detailed description and the accompanying drawings in which.

DESCRIPTION OF THE PREFERRED EMBODIMENTS

Figure 1:
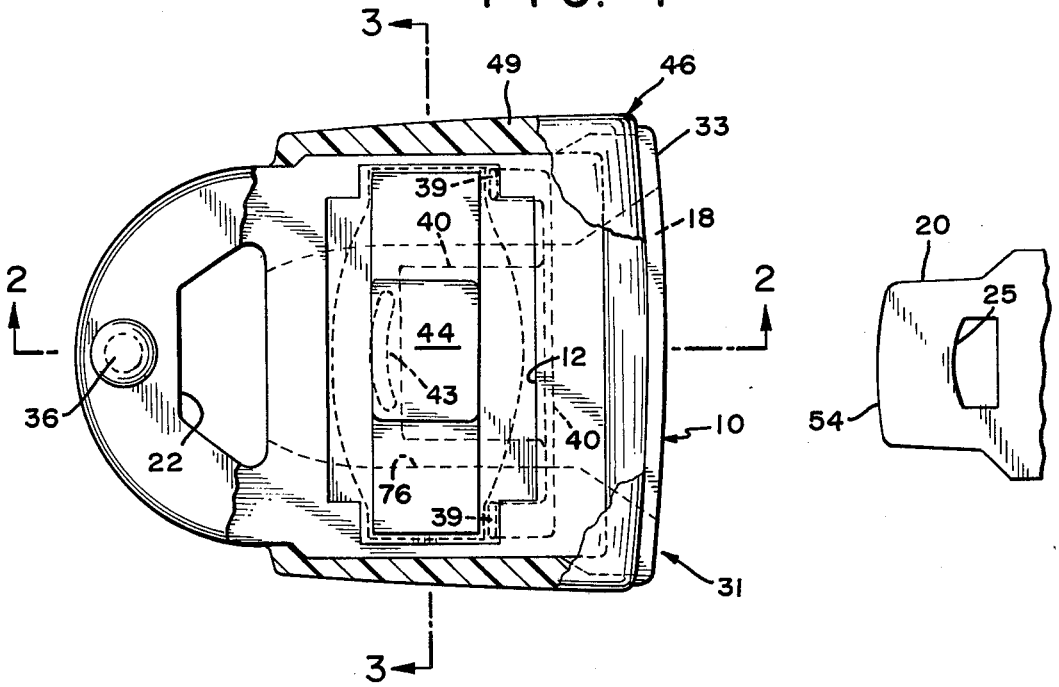
FIG. 1 is a plan view of the safety belt buckle of the present invention.
Figure 2:
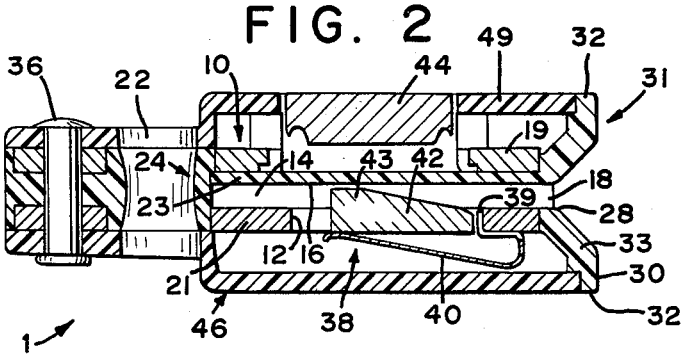
FIG. 2 is a longitudinal section taken along line 2—2 of FIG. 1.
Figure 3:
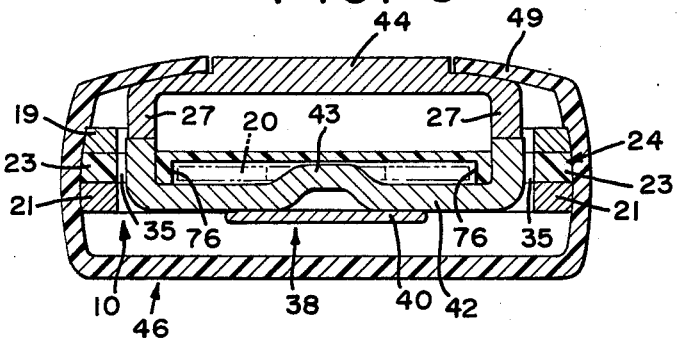
FIG. 3 is a section taken along the line 3—3 of FIG. 1.
Figure 4:
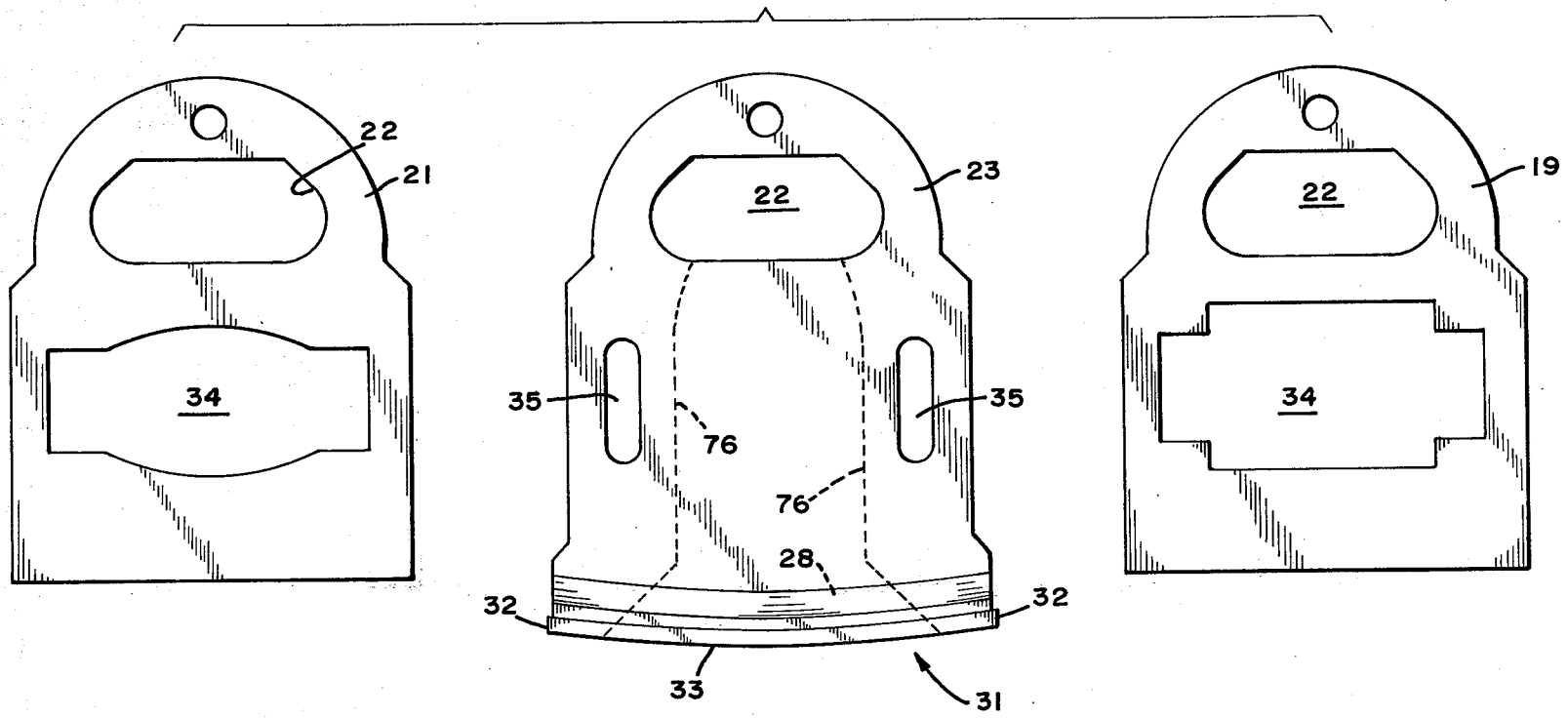
FIG. 4 is a plan view of a plurality of plates adapted for assembly to form the housing means of the buckle shown in FIG. 1.
Figure 5:
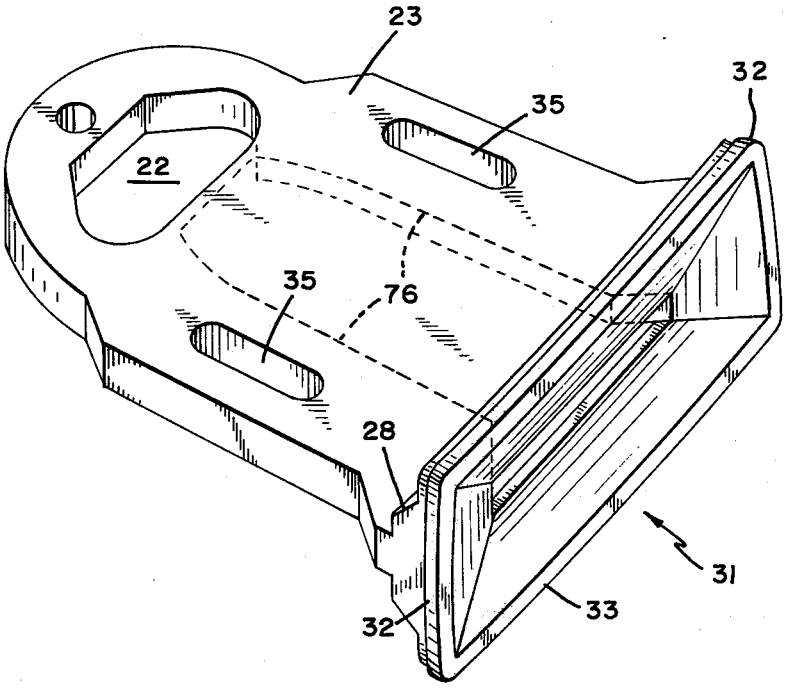
FIG. 5 is a prospective view of a center plate shown in FIG. 4.

Referring to FIGS 1–3 of the drawings, there is illustrated the safety belt buckle of this invention. The buckle, shown generally at 1, contains a housing, shown generally at 10 having an opening 12 therein from which a cavity 14 extends to a wall 16 of the housing opposite the opening 12. Housing 10 is provided with an inlet means 18 which communicates with the cavity 14 for receiving the tongue 20 of a seat belt (not shown). The housing 10 has connecting means 22 for connecting the housing to the seat belt. Housing 10 is formed of a plurality of laminated plates shown generally at 24. As shown in FIG. 4, the top and bottom plates 19 and 21, respectively, have an opening 34 in the central portion thereof and the center plate 23 has an opening 28 extending from an edge 30 of the plate into the central portion thereof, the opening 28 forming part of the inlet means 18. The center plate has a guide means, generally indicated at 31, extending from the interior of the cavity to a point of termination 32 on the exterior surface of the housing 10 for guiding the tongue 20 into the cavity 14 of the housing 10.

The number of laminated plates employed can vary depending on the depth of the cavity and the type of material of the plates. Typically, the top and bottom plates 19 and 21 are diestamped from metal such as steel, aluminum, or the like, and the center plate is injection molded or otherwise formed of a polymeric material. Suitable polymeric materials include thermoplastic resins such as acetal homopolymer or copolymer or polycarbonate, as well as thermosetting resins such as of the phenolic type. Preferably the housing 10 is comprised of at least three plates, including top, center and bottom plates. Each of the plates 19, 21 and 23 are formed using conventional equipment at very low cost.

The housing 10 is assembled by sandwiching biasing means 40 and bottom and top plates 19 and 21, respectively about center plate 23 and fastening the assembled plates together by mechanical fastening means, such as rivets 36. The plates can, alternatively, be spot-welded or adhesively secured together using suitable epoxy resins or the like. Upon assembly of the plates to form an integral laminated housing unit, guide means 31 is formed by spaced apart parallel walls 76 and bell-shaped extension 33 of which center plate 23 is comprised. The center plate is provided with a recess defined by walls 76 and extending from an edge of the plate into the central portion thereof, such recess forming part of the inlet means. The walls 76 and the extension 33 cooperate with the tip 54 of the tongue 20 to eliminate rough entry of the tongue during its insertion into cavity 14.

Referring to FIGS. 1–3 of the drawings, a latching means and cover are shown in relation to the housing 10. The latching means, shown generally at 38, includes a biasing means 40, a latch bar 42 having a raised portion 43 adapted to mate with opening 25 of tongue 20, and a pushbutton 44. The latch bar 42 has a plurality of shoulders 27 adapted to move within passages 35 of center plate 23. End portion 39 of biasing means 40 extends into passages 35 and provides smooth, continuous surface for co-action with latch bar 42. The biasing means 40 and latch bar 42 are disposed in the cavity 14 with at least portions thereof positioned in serial overlapping relationship in the direction in which the cavity extends into the housing. Preferably, a cover, generally indicated at 46, is disposed about the housing 10. The cover 46 comprises a single piece 49 of light weight plastic or the like. Cover 46 does not add appreciably to the strength or weight of the assembly but functions primarily to protect the components therein against contamination and accidental damage due to tampering. The cover 46 has sufficient strength and rigidity to withstand forces generated during depression of the pushbutton 44, and may, therefore, be used to support the biasing means 40. Preferably, the biasing means 40 is secured to housing 10 by the mechanical fastening means and does not contact the cover 46 when the latching means 38 is in the latched and unlatched positions. In the latter embodiment, the latching means 38 is functionally independent of the cover 46 and is not disabled by damage thereto.

A switch means (not shown) comprising a movable contact arm connected to a souce of electrical power and adapted to be moved into contact with a contact member connected to starter engine interlock and/or alarm circuitry of the vehicle may also be associated with the housing 10. The switch means is preferably disposed in a second cavity of the housing 10 so that an arm thereof is pushed against the force of a spring and into contact with the contact member by the tip 54 of tongue 20 upon insertion of the tongue 20 into the housing 10.

In operation, the tongue 20 is inserted into inlet means 18 and cavity 14, bringing opening 25 above raised portion 43 of latch bar 42. The biasing means 40 moves the raised portion 43 into locking engagement with opening 25 of tongue 20. In the event that the buckle 1 includes a switch means, the tip 54 of tongue 20 pushes an arm of the switch means into contact with a contact member, whereby an electrical signal is transmitted to circuitry for disabling the engine interlock and/or alarm means of the vehicle. To disengage the belt, pushbutton 44 is depressed. Shoulders 27 of the button force latch bar 42 downward until the raised portion 43 is below the opening 25 of tongue 20.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. A safety belt buckle comprising:

a. a housing having an opening therein and provided with a cavity extending from said opening to a wall of said housing opposite said opening;

b. inlet means communicating with said cavity for receiving a tongue of a seat belt;

c. connecting means for connecting the housing to the seat belt;

d. movable latching means for engaging the tongue of said seat belt;

e. manually operable actuation means for actuating said latching means;

f. said housing formed of at least three laminated plates in contact with one another and secured together, said laminated plates including a first plate, a second plate and a third plate, said second plate disposed between said first plate and said third plate;

g. each of said plates having a cavity in the central portion thereof, said cavities in substantial alignment with one another;

h. said cavity in at least said second plate extending from an edge of said second plate into the central opening thereof for receiving said tongue, a portion of said latching means extending in and movable within said cavity of at least said second plate and said third plate, a portion of said actuating means extending in and movable in said cavity of at least said first plate;

i. said second plate being made of a polymeric material and further including guide means extending from the interior of said cavity to a point of termination on the exterior surface of said housing for guiding the tongue into the housing.

2. A safety belt buckle as recited in claim 1, wherein said guide means forms part of the exterior surface of said housing.

3. A safety belt buckle as recited in claim 2, wherein said housing is provided with a protective cover disposed about the remaining part of said exterior surface.

4. A safety belt buckle as recited in claim 2, wherein the portion of said guide means forming part of said exterior surface has a substantially bell-shaped configuration.

5. A safety belt buckle as recited in claim 2, wherein said guide means includes spaced apart parallel walls.

6. A safety belt buckle as recited in claim 3, wherein said latching means is functionally independent of said protective cover.

7. A safety belt buckle as recited in claim 1, wherein said polymeric material is composed of thermosetting resin.

8. A safety belt buckle as recited in claim 7, wherein said thermosetting resin is a phenolic resin.

9. A safety belt buckle as recited in claim 1, wherein said polymeric material is composed of thermoplastic resin.

10. A safety belt buckle as recited in claim 9, wherein said thermoplastic resin is selected from a group consisting of an acetal homopolymer and an acetal copolymer.

11. A safety belt buckle as recited in claim 9, wherein said thermoplastic resin is a polycarbonate.

12. A safety belt buckle as recited in claim 6, wherein a biasing means cooperates with the latching means, said biasing means being independent of the cover and providing a surface for co-action with the latching means.

13. A safety belt buckle as recited in claim 1 wherein said manually operable actuation means is a push-button extending into said opening of said first plate and connected to said latching means, said push-button being the sole mechanism for releasing said tongue from said buckle housing.

* * * * *